US007457579B2

(12) United States Patent
Morimoto

(10) Patent No.: US 7,457,579 B2
(45) Date of Patent: Nov. 25, 2008

(54) DOCUMENT READER AND IMAGE FORMING APPARATUS

(75) Inventor: Yasumasa Morimoto, Kashihara (JP)

(73) Assignee: Sharp Kabushiki Kaisha, Osaka (JP)

( * ) Notice: Subject to any disclaimer, the term of this patent is extended or adjusted under 35 U.S.C. 154(b) by 186 days.

(21) Appl. No.: 11/250,397

(22) Filed: Oct. 17, 2005

(65) Prior Publication Data

US 2006/0083565 A1 Apr. 20, 2006

(30) Foreign Application Priority Data

Oct. 18, 2004 (JP) ..... 2004-303578

(51) Int. Cl.
*G03G 15/00* (2006.01)

(52) U.S. Cl. ..... 399/370; 399/376; 399/386; 399/389; 271/9.06

(58) Field of Classification Search ..... 399/370, 399/376, 389, 386; 271/9.06
See application file for complete search history.

(56) References Cited

U.S. PATENT DOCUMENTS 4,600,266 A * 7/1986 Omi ..... 359/18
5,839,019 A * 11/1998 Ito ..... 399/45
6,009,303 A * 12/1999 Kumagai et al. ..... 399/370
6,266,512 B1 * 7/2001 de Koning et al. ..... 399/370

FOREIGN PATENT DOCUMENTS

| | | | |
|---|---|---|---|
| JP | 6-230629 | A | 8/1994 |
| JP | 7-95364 | A | 4/1995 |
| JP | 9-274341 | A | 10/1997 |
| JP | 9-331418 | A | 12/1997 |
| JP | 11-167229 | A | 6/1999 |
| JP | 2001-13740 | A | 1/2001 |
| JP | 2002-244500 | A | 8/2002 |
| JP | 2004-48282 | A | 2/2004 |
| JP | 2004-107018 | A | 4/2004 |

* cited by examiner

*Primary Examiner*—Ren Yan
*Assistant Examiner*—Andy L Pham
(74) *Attorney, Agent, or Firm*—Birch, Stewart, Kolasch & Birch, LLP

(57) ABSTRACT

A document size sensor is disposed on a document feed path at a location between a document tray and a juncture and on the front side in the primary scanning direction perpendicular to a document feed direction. The document size sensor is located between a sheet edge position for B4-size document sheet and a sheet edge position for A 4 -size document sheet, which are situated on the front side in the primary scanning direction. The document size sensor detects A3 - and B 4 -size document sheets but does not detect A 4 - or B5-size document sheet. Based on a detection signal from the document size sensor, judgment is made as to whether a document sheet fed from the document tray is a larger-sized document sheet or a smaller-sized document sheet.

4 Claims, 7 Drawing Sheets

DOCUMENT READER AND IMAGE FORMING APPARATUS

CROSS REFERENCE

This Nonprovisional application claims priority under 35 U.S.C. § 119(a) on Patent Application No. 2004-303578 filed in Japan on Oct. 18, 2004, the entire contents of which are hereby incorporated by reference.

BACKGROUND OF THE INVENTION

The present invention relates to a document reader configured to feed plural document sheets placed on a document tray to a document read position one by one and read image information from each of the document sheets. The present invention also relates to an image forming apparatus configured to form an image on a recording medium based on image information read from a document sheet by the document reader.

Recent years have seen a progressing development of document readers of the type adapted to read image information from document sheets at a predetermined image read position during feeding of the document sheets one by one, as disclosed in Japanese Laid-open Patent Application No. H07-095364.

Such a document reader defines therein a document feed path extending from the document tray, through the image read position, to the delivery tray. The document tray is capable of receiving plural document sheets as stacked thereon. The delivery tray receives the document sheets as stacked thereon after the reading of image information therefrom.

The light-receiving surface of an image reading device faces the image read position on the document feed path either directly or via a deflecting mirror. Each document sheet under feeding on the document feed path travels in the secondary scanning direction with respect to the light-receiving surface of the image reading device. While the length of the document sheet from the leading edge thereof to the trailing edge thereof in the document feed direction passes through the image read position, the image reading device reads image information from the entire image bearing side of the document sheet.

However, a conventional document reader cannot read image information continuously from a series of differently sized document sheets including, as mixed, an A3-size document sheet and a B5-size document sheet for example, though can read image information continuously from a series of single-sized document sheets placed on the document tray.

The conventional document reader has a document sensor disposed on the document feed path at a location intermediate the document tray and the image read position for detecting the presence and absence of a document sheet so that an occurrence of a document feed failure is detected based on a detection signal from the document sensor. The document reader stops operating upon an occurrence of a change in duration of detection by the document sensor, which is regarded as an occurrence of a document feed failure. For this reason, when a change in document sheet size occurs during successive feeding of plural document sheets, a change in duration of detection by the document sensor occurs, which causes the document reader to stop operating. Thus, it becomes impossible to feed document sheets.

There exists no conventional document reader configured to determine the length of a document sheet in the primary scanning direction during feeding of the document sheet, though there exists a document reader of the type configured to determine the length of a document sheet placed on the document tray in the document feed direction (the direction perpendicular to the primary scanning direction).

Accordingly, even if plural document sheets of different sizes are fed successively by the neglect of the detection signal from the document sensor, image information reading from the same range as the dimension of a maximum-size document sheet is performed with respect to a document sheet of a smaller size in the primary scanning direction. This means that unnecessary image information from outside the image region of the smaller-sized document sheet is also read and processed. As a result, such a conventional document reader has the problem that the demand for higher-speed image reading cannot be satisfied.

Also, an image forming apparatus for forming an image on a recording medium with use of image information read by such a document reader performs image formation based on such unnecessary image information. Further, the image forming apparatus forms an image on a recording medium of an unnecessarily large size relative to the image information. Thus, the image forming apparatus has the problem that the demand for higher-speed image formation and resources saving cannot be satisfied.

A feature of the present invention is to provide a document reader capable of determining the length of a document sheet in the primary scanning direction immediately after start feeding of the document sheet to avoid reading of unnecessary image information from outside the image region of a smaller-sized document sheet, thereby continuously reading image information from a series of differently sized document sheets including mixed document sheets of different sizes. Another feature of the present invention is to provide an image forming apparatus capable of image formation based on image information continuously read from a series of such differently sized document sheets without waste.

SUMMARY OF THE INVENTION

A document reader according to the present invention includes a document tray, a document feed path, an image reading device, at least one sensor, and a judgment section. The document tray is provided for document sheets of different sizes to be placed thereon. The document feed path feeds the document sheets one by one from the document tray. The image reading device is configured to read image information from each of the document sheets under feeding at an image read position on the document feed path. The sensor is configured to detect the presence or absence of a document sheet at a location on the document feed path between the document tray and the image read device, and between first and second positions on which respective edges of different-sized first and second document sheets to be placed on the document tray pass. The first and second positions are situated on at least one side of the document feed path in a direction perpendicular to a sheet feed direction. The judgment section is configured to judge which of the first and second document sheets is under feeding based on a result of detection by the sensor.

The foregoing and other features and attendant advantages of the present invention will become more apparent from the reading of the following detailed description of the invention in conjunction with the accompanying drawings.

DETAILED DESCRIPTION OF THE PREFERRED EMBODIMENTS

Hereinafter, preferred embodiments of document reader and image forming apparatus according to the present invention will be described in detail with reference to the accompanying drawings.

Figure 1:
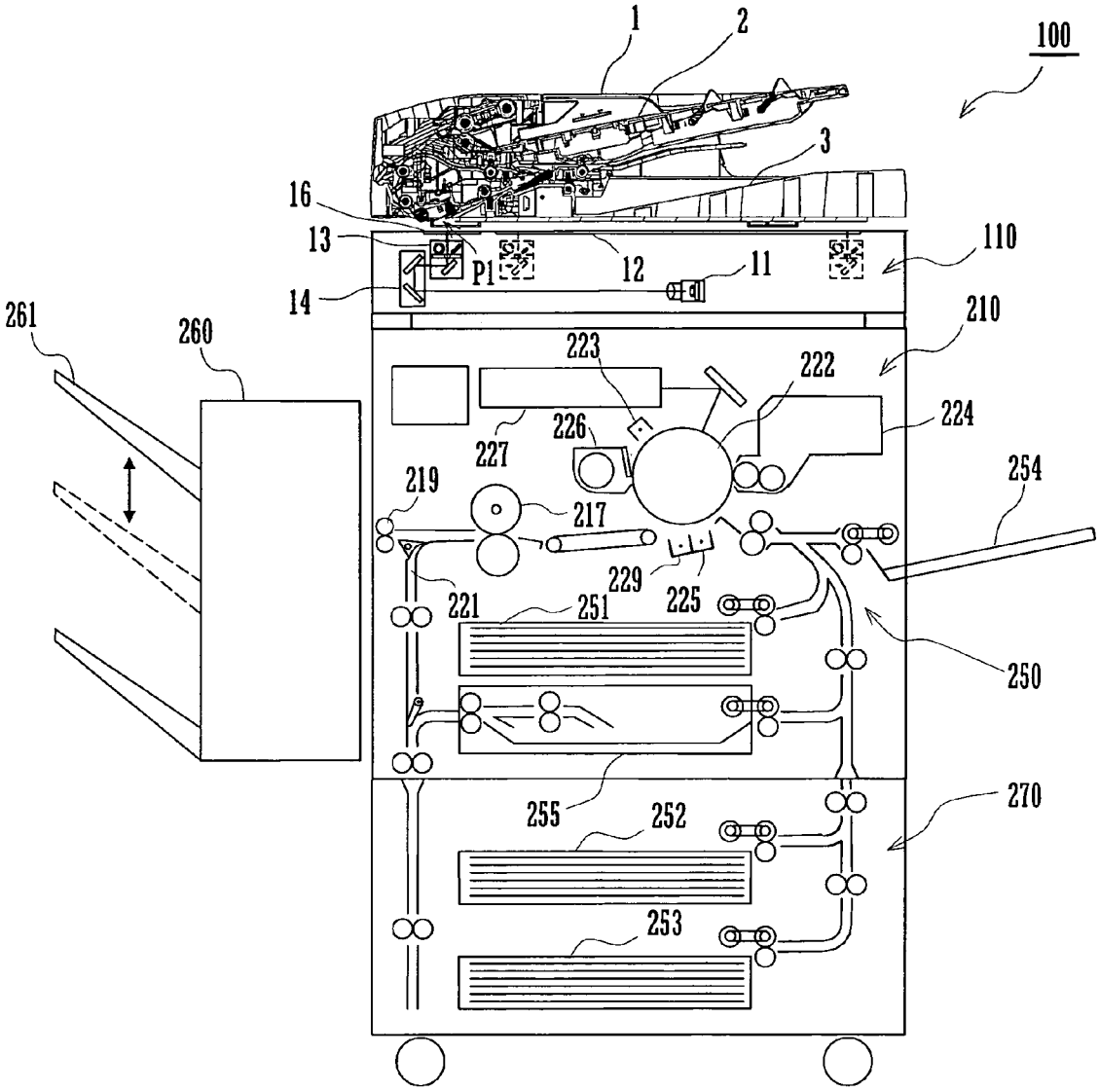
FIG. 1 is a view showing the construction of image forming apparatus 100 according to an embodiment of the present invention.

FIG. 1 is a view showing the construction of image forming apparatus 100 according to an embodiment of the present invention. The image forming apparatus 100 includes an image read section 110 comprising an image reader 1 according to the present invention, an image forming section 210, and a sheet feed section 250 and is provided with a post-processing device 260 and a multi-tier sheet feeder unit 270.

Image data read from a document by the image read section 110 is transferred to the image forming section 210. The image data thus transferred is subjected to predetermined image processing in an image processing section of the image forming section 210 and then temporarily stored in memory incorporated in the image processing section. In response to an instruction to output the stored image data, the image data is read out of the memory.

The image forming section 210 includes a rotatably supported photoreceptor drum 222, and, around the photoreceptor drum 222, an electrostatic charger 223, a laser write unit 227, a developing device 224, a transfer device 225, a peeler 229, and a cleaner 226.

The electrostatic charger 223 is configured to charge the surface of the photoreceptor drum 222 to a predetermined potential. The laser write unit 227 is configured to form an electrostatic latent image on the surface of the photoreceptor drum 222 by irradiating the surface of the photoreceptor drum 222 with laser light modulated according to image data. The developing device 224 is configured to supply toner onto the electrostatic latent image formed on the photoreceptor drum 222 to develop the latent image into a visible toner image. The transfer device 225 is configured to transfer the toner image formed on the surface of the photoreceptor drum 222 to a recording sheet. The peeler 229 is configured to release the recording sheet from the surface of the photoreceptor drum 222. The cleaner 226 is configured to collect excess toner.

Instead of the laser write unit 227, use may be made of an optical write head of the solid state scanning type employing a light-emitting device array comprising LEDs, ELs or the like.

Below the image forming section 210 is located the sheet feed section 250 which comprises a recording sheet tray 251, a manual feed tray 254 and a reversing unit 255. The multi-tier sheet feed unit 270 includes sheet feed trays 252 and 253. The sheet feed section 250 defines a sheet feed path for transporting a recording sheet fed from any one of the trays 251 to 254 to an ejected-sheet tray 219 via a transfer position between the photoreceptor drum 222 and the transfer device 225 in the image forming section 210.

The reversing unit 255 communicates with a switchback path 221 for turning a recording sheet front side back for formation of an image on the reverse side of the sheet. The reversing unit 255 is replaceable with a normal sheet tray. The image forming apparatus 100 can be fitted with a large-capacity sheet feed unit capable of holding several thousands of recording sheets.

On the ejection side of the image forming section 210 are provided a fixing unit 217, the switchback path 221, and the post-processing device 260. The fixing unit 217 is configured to fix a toner image to a recording sheet by heating and pressurizing the recording sheet bearing the toner image transferred thereto. The switchback path 221 is configured to turn a recording sheet front side back for the formation of an image on the reverse side of the sheet. The post-processing device 260 is provided with an up-and-down tray 261 and performs stapling or other processing on recording sheets bearing respective images formed thereon. Each recording sheet bearing a toner image fixed thereto by the fixing unit 217 is guided to the post-processing device 260 by an ejection roller 219 optionally through the switchback path 221, subjected to predetermined post-processing, and then ejected to the up-and-down tray 261.

The image read section 110 includes a CCD (Charge Coupled Device) read unit 11 and is configured to perform image reading by using a light source unit 13 and a mirror unit 14 to focus an image of a document sheet placed flat on a first platen 12 onto the CCD read unit 11. The CCD read unit 11 includes an imaging lens 11A and a CCD image sensor corresponding to the image reading device defined by the present invention.

The light source unit 13 includes a light source for emitting document-illuminating light, a reflector for gathering document-illuminating light emitted from the light source at a predetermined image read position on the first platen 12, a slit allowing only reflected light from the document sheet to pass therethrough, and a mirror for deflecting the optical path of the reflected light having passed through the slit by 90°. The mirror unit 14 includes a pair of mirrors for deflecting the optical path of light from the light source unit 13 by 180°.

In a stationary document read mode, the light source unit 13 and the mirror unit 14 reciprocate below the first platen 12 in the secondary scanning direction at a predetermined velocity of V and a velocity of V/2, respectively, thereby guiding reflected light from the entire image bearing surface of the document sheet on the first platen 12 to the CCD read unit 11 with the optical path length kept constant.

The CCD read unit 11 may be structured to reciprocate a unit of an optical read system for reduced-size reading or actual-size reading comprising a CCD image sensor, an imaging lens and a light source below the first platen 12 at a velocity of V in the stationary document read mode.

The image read section 110 further includes a second platen 16 spaced a predetermined distance apart from the first platen 12 in the secondary scanning direction. In a feed-and-read mode in which the document reader 1 is used, the light source unit 13 is held stationary at image read position P1 opposed to the second platen 16.

Figure 2:
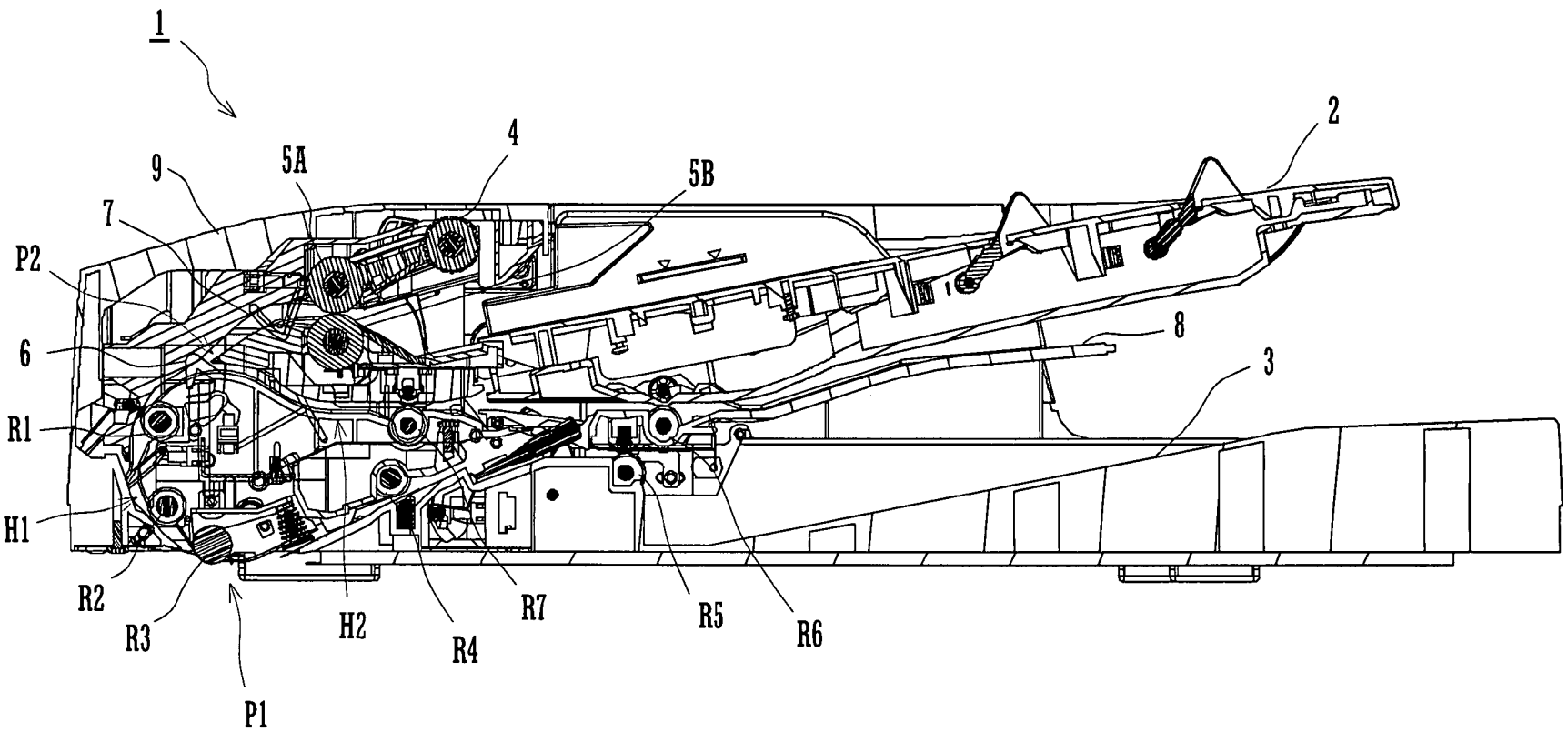
FIG. 2 is a view showing the construction of document reader 1 according to an embodiment of the present invention.
Figure 3:
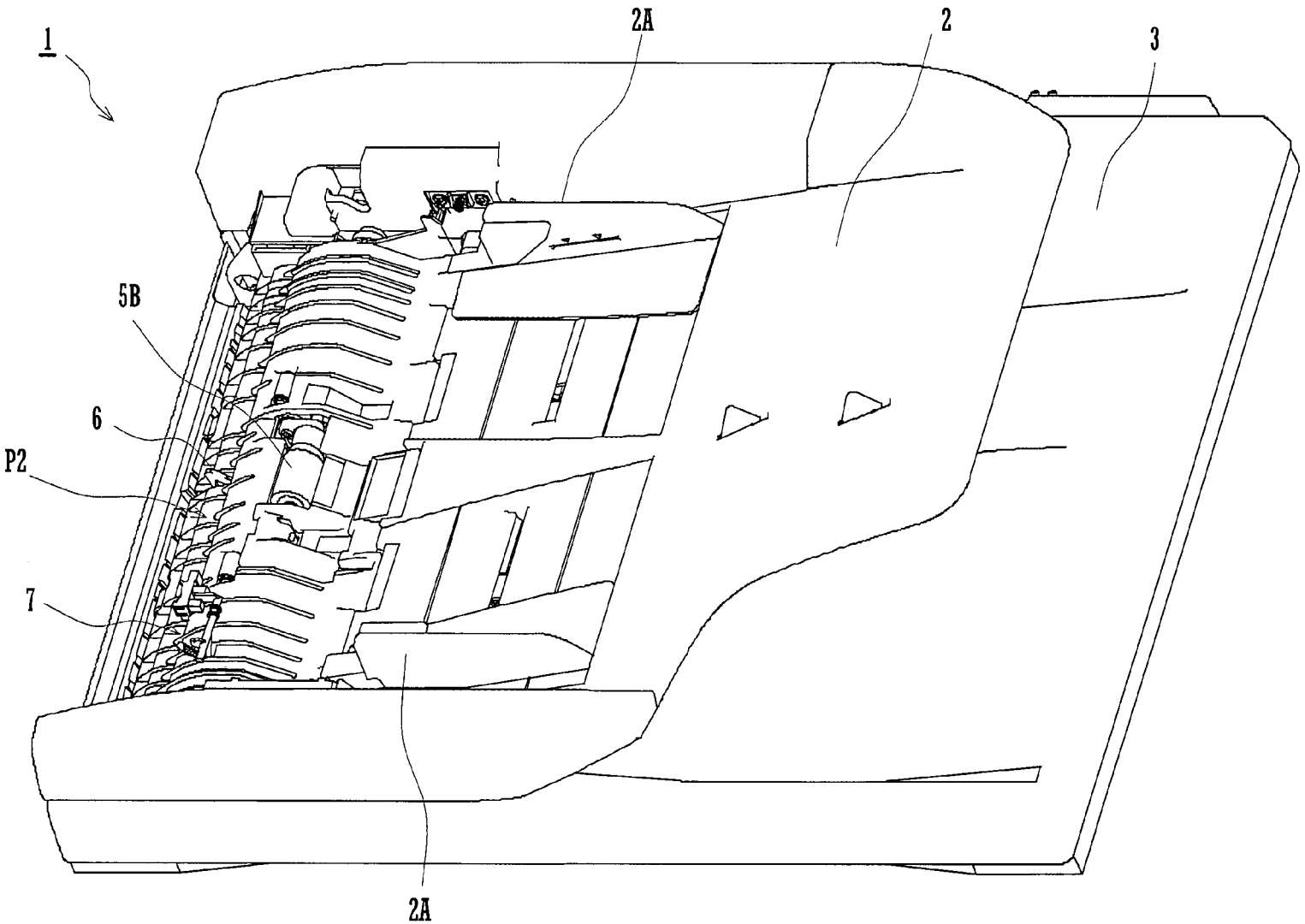
FIG. 3 is a view showing an outward appearance of the document reader 1 with its cover open.

FIG. 2 is a view showing the construction of document reader 1 according to an embodiment of the present invention. FIG. 3 is a view showing an outward appearance of the document reader 1 with its cover open. The document reader 1 is positioned above the image read section 110 so as to be capable of covering and exposing the top surfaces of the first and second platens 12 and 16.

The document reader 1 includes a document tray 2, a delivery tray 3, and a switchback tray 8. The document tray 2 holds plural document sheets as stacked thereon. The delivery tray 3 receives, as stacked thereon, document sheets having been subjected to image information reading. The switchback tray 8 temporarily receives a document sheet having been subjected to image information reading from one side thereof in a double side read mode.

A document feed path H1 is defined to extend from the document tray 2 to the delivery tray 3 through the image read position P1. The document feed path H1 is provided with a pickup roller 4, a feed roller 5A, a separating roller 5B, and transport rollers R1 to R5. Also, a secondary feed path H2 is defined to connect the switchback tray 8 to a juncture P2 located intermediate the document tray 2 and the image read position P1 on the document feed path H1. The secondary feed path H2 is provided with a delivery roller R6 and a transport roller R7.

A cover member 9 supports the pickup roller 4, feed roller 5A and separating roller 5B. The cover member 9 is hinged on the left-hand side in FIG. 2 for pivotal movement to expose and cover an upper portion of the document feed path H1.

In a one-side document read mode for reading image information from only one side of each document sheet, a document sheet is paid out by rotation of the pickup roller 4 abutting against the topmost surface of a stack of document sheets placed on the document tray 2 and then guided into the document feed path H1 by rotation of the feed roller 5A. At that time, the separating roller 5B rotating in the same direction as the feed roller 5A pushes back document sheets other than the topmost document sheet onto the document tray 2, so that only the topmost document sheet is fed into the document feed path H1.

The document sheet fed from the document tray 2 is transported on the document feed path H1 toward the image read position P1 with predetermined timing by the transport rollers R1 and R2 rotating. As the document sheet passes through the image read position P1, image information is read by the CCD read unit 11 of the image read section 110 including the light source unit 31 held stationary below the image read position P1. The document sheet having been subjected to image information reading is delivered onto the delivery tray 3 by the transport rollers R4 and R5 rotating.

In a double-side document read mode for reading image information from the both sides of each document sheet, a single document sheet fed into the document feed path H1 is subjected to image information reading from one side thereof as in the one-side document read mode, guided into the secondary feed path H2 by the transport roller R4, and then transported onto the switchback tray 8 by rotation of the delivery roller R6. The delivery roller R6 rotates backwardly with the trailing edge of the document sheet nipped thereby. Then, the document sheet is turned front side back and transported on the secondary feed path H2 toward the juncture P2 by the delivery roller R6 and transport roller R7 rotating.

The document sheet transported on the secondary feed path H2 to the juncture P2 is then transported on the document feed path H1 toward the image read position P1 again. At the image read position P1, the reverse side of the document sheet, which is opposite from the side from which the image information has already been read, faces the light source unit 13 held stationary below the image read position P1 so as to be subjected to image information reading. The document sheet having been subjected to image information reading from its both sides is delivered onto the delivery tray 3 by the transport rollers R4 and R5 rotating.

A document sensor 6 is disposed on the document feed path H1 at a location immediately downstream of the juncture P2. The document sensor 6 is configured to detect a document sheet passing through the document feed path H1 from the document tray 2 or the switchback tray 8.

A document size sensor 7, which corresponds to the sensor defined by the present invention, is disposed on the document feed path H1 at a location intermediate the document tray 1 and the juncture P2 and on the front side in the primary scanning direction perpendicular to the document feed direction. The document size sensor 7 is configured to detect an edge position of a document sheet fed from the document tray 2 in the primary scanning direction.

Figure 4:
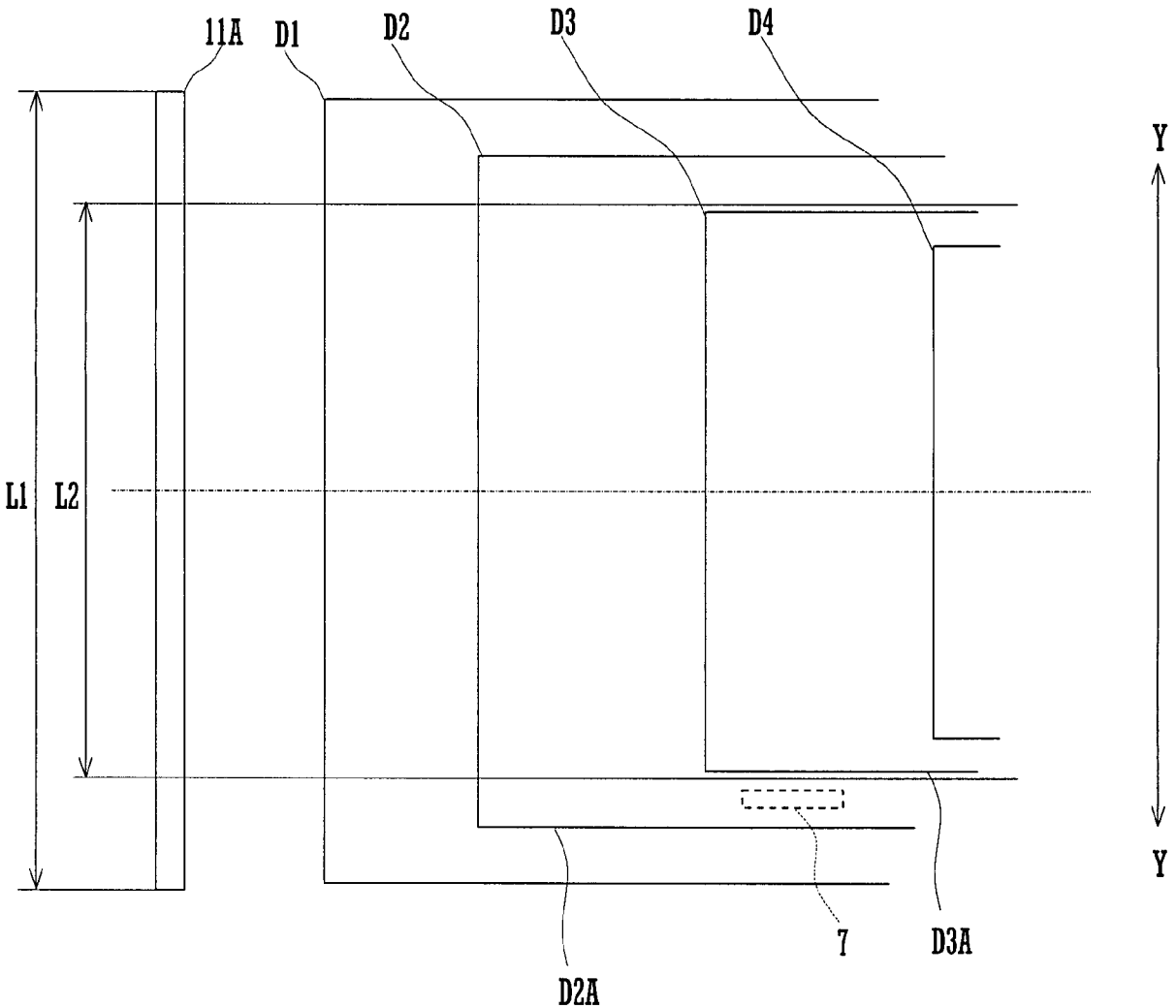
FIG. 4 is a schematic diagram illustrating the location of a document size sensor 7 in the document reader 1.

FIG. 4 is a schematic diagram illustrating the location of the document size sensor 7 included in the aforementioned document reader 1. The document reader 1 according to the present embodiment is capable of feeding a document sheet of A3 size or smaller. The CCD image sensor 11A of the CCD read unit 11 included in the image read section 110 of the image forming apparatus 100 is configured to read image information from a range L1 which is slightly longer than the length of A3-size document sheet D1 in the primary scanning direction (Y-Y direction) perpendicular to the sheet feed direction.

The document size sensor 7 is located between sheet edge position D2A for B4-size document sheet D2 smaller than A3-size document sheet D1 and sheet edge position D3A for A4-size document sheet D3 smaller than B4-size document sheet D2, the sheet edge positions D2A and D3A being situated on the front side in the primary scanning direction. Accordingly, the document size sensor 7 can detect A3-size document sheet D1 (which is meant to include an A4-size document sheet placed in portrait orientation) and B4-size document sheet D2 ((which is meant to include an A5-size document sheet placed in portrait orientation) but cannot detect A4-size document sheet D3 or B5-size document sheet D4.

Thus, it is possible to judge whether a document sheet fed from the document tray 2 is a larger-sized document sheet (A3- or B4-size document sheet) or a smaller-sized document sheet (A4- or B5-size document sheet) according to whether or not the document size sensor 7 has detected the document sheet.

It should be noted that in the document reader 1 each document sheet is fed as centered on a center position in the primary scanning direction.

Additional document size sensor 7 may be disposed on the rear side in the primary scanning direction at a location between a sheet edge position for B4-size document sheet D2 and a sheet edge position for A4-size document sheet D3. In the primary scanning direction it is possible to further provide additional document sensor 7 at either or both of a location between the front-side sheet edge position for A3-size document sheet D1 and the front-side sheet edge position for B4-size document sheet D2 and a location between the rear-side sheet edge position for A3-size document sheet D1 and the rear-side sheet edge position for B4-size document sheet D2, or at either or both of a location between the front-side sheet edge position for A4-size document sheet D3 and the front-side sheet edge position for B5-size document sheet D4 and a location between the rear-side sheet edge position for A4-size document sheet D3 and the rear-side sheet edge position for B5-size document sheet D4.

Further, the document size sensor 7 may be disposed so as to be movable in the primary scanning direction. In this case the document size sensor 7 can be fixed at any one of the aforementioned locations selectively. Alternatively, such an arrangement is possible that the location of the document size sensor 7 in the primary scanning direction can be changed with a change in the position of a document guide 2A defining a sheet edge position of a document sheet placed on the document tray 2 in the primary scanning direction.

Figure 5:
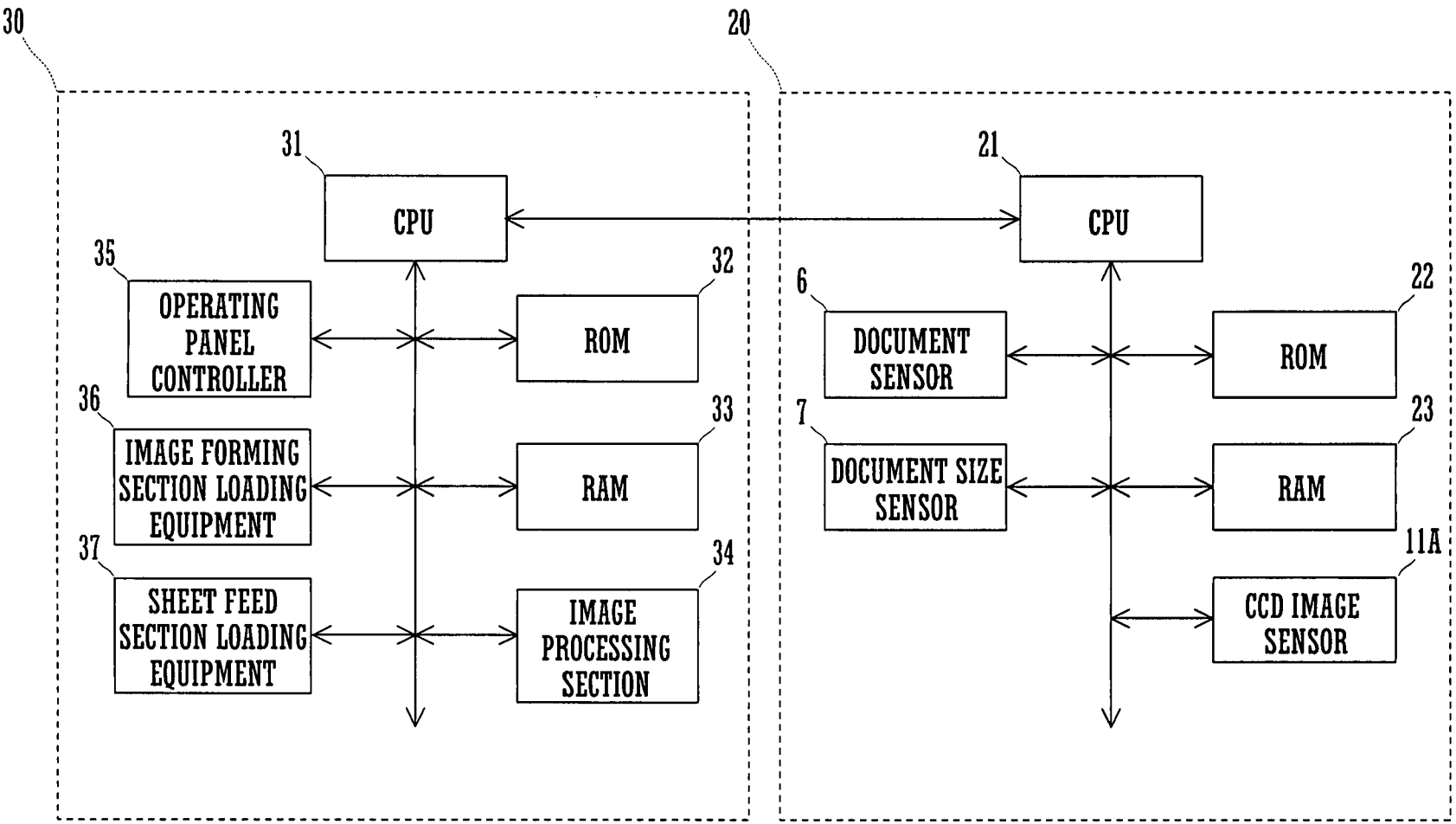
FIG. 5 is a block diagram illustrating the configuration of control section 30 included in the image forming apparatus 100 and the configuration of control section 20 included in the document reader 1.

FIG. 5 is a block diagram illustrating the configuration of control section 30 included in the image forming apparatus 100 and the configuration of control section 20 included in the document reader 1. The control section 20 of the document reader 1 comprises a CPU 21 including ROM 22 and RAM 23, the CPU 21 being connected to the document sensor 6, document size sensor 7, CCD image sensor 11A and other components. The CPU 21 constituting the control section 20 of document reader 1 is connected to a CPU 31 constituting the control section 30 of the image forming apparatus 100.

The control section 30 of the image forming apparatus 100 comprises CPU 31 including ROM 32 and RAM 33, the CPU 31 being connected to input/output devices including image processing section 34, operating panel controller 35, image read section loading equipment 36, image forming section loading equipment 37, sheet feed section loading equipment 38, and the like.

In the control section 20 of the document reader 1 the CPU 21 outputs image information read from a document sheet by the CCD image sensor 11A to the CPU 31.

Also, the CPU 21 judges whether or not a document feed failure has occurred based on a detection signal from the document sensor 6. If it is judged that the document feed failure has occurred, the CPU 21 outputs feed failure information to the CPU 31. Because the CPU 21 recognizes a proper duration of a document detecting state of the document sensor 6 from the size of a document sheet being fed and the document feed speed, the CPU 21 judges that the document feed failure has occurred if the duration of the detection signal from the document sensor 6 is different from the proper duration.

As described above, the document sensor 6 is disposed on the document feed path H1 at a location immediately downstream of the juncture P2 with the secondary feed path H2. For this reason, it is possible for the CPU 21 to judge whether or not the document feed failure has occurred not only after feeding of a document sheet from the document tray 2 but also after feeding of a document sheet from the switchback tray 8 based on the detection signal from the document sensor 6.

The CPU 21 judges the size of a document sheet placed on the document tray 2 based on a detection signal from a sensor provided on the document tray 2, and stores document size information on the size thus judged while outputting it to the CPU 31 of the image forming apparatus 100.

In reading image information from a series of differently sized document sheets including mixed document sheets of different sizes (differently-sized document read mode), the CPU 31 outputs smaller document size information to the CPU 31 based on the detection signal from the document size sensor 7. Specifically, when the document size sensor 7 changes from a document detecting state where the document size sensor 7 is detecting a larger-sized document sheet fed from the document tray 2 at a preceding feed into a document non-detecting state where the document size sensor 7 is not detecting any document sheet at a next feed, the CPU 21 judges the document sheet just fed from the document tray 2 as being a smaller-sized document sheet and then outputs smaller document size information to the CPU 31.

In the control section 30 of the image forming apparatus 100 the operating panel controller 35 inputs operation data on a key switch 41 provided on the operating panel of the image forming apparatus 100 to the CPU 31 and causes a display 42 of the operating panel to display indication data outputted from the CPU 31.

The CPU 31 establishes image forming conditions based on the operation data on the key switch 41 inputted from the operating panel controller 35. Such image forming conditions include a document sheet size, a recording sheet (recording medium) size, an image forming magnification, an image density, an image forming mode, and a like condition. When two of the document sheet size, recording sheet size and image forming magnification are established by operation on the key switch 41, the remaining one is automatically established. The image forming mode is either a one-side image forming mode for forming an image on only one side of a recording sheet (recording medium) or a double-side image forming mode for forming images on both sides of a recording sheet.

When the differently-sized document read mode is selected at the operating panel, the CPU 31 outputs to the CPU 21 differently-sized document information informing that a series of differently sized document sheets including mixed document sheets of different sizes is placed on the document tray 2.

When smaller document size information is inputted to the CPU 31, the CPU 31 changes the currently established recording sheet size based on the smaller document size information and the previously established image forming magnification. Also, the CPU 31 changes the developing bias value or the quantity of light for exposure based on information on an image density established as one of the image forming conditions.

The CPU 31 causes the image processing section 34 to perform predetermined image processing on image information inputted from the CPU 21. The image information is temporarily stored as image data in memory included in the image processing section 34 and then transferred to the laser write unit 227 included in the image forming section loading equipment 36 with predetermined timing.

The image forming section loading equipment 36 includes, in addition to the laser write unit 227 including a semiconductor laser and a mirror motor, a main motor for generating rotational force for the photoreceptor drum 222, a power source circuit for applying a developing bias to the developing roller of the developing unit 224, and other components.

The sheet feed section loading equipment 37 includes a clutch for transmitting rotation to the transport rollers and the like on the sheet feed paths, a solenoid for operating a flapper, and other components.

When the CPU 31 receives feed failure information inputted from the CPU 21, the CPU 31 causes the motor, solenoid, clutch and the like included in the image forming section loading equipment 36 and sheet feed section loading equipment 37 to stop operating.

Figure 6:
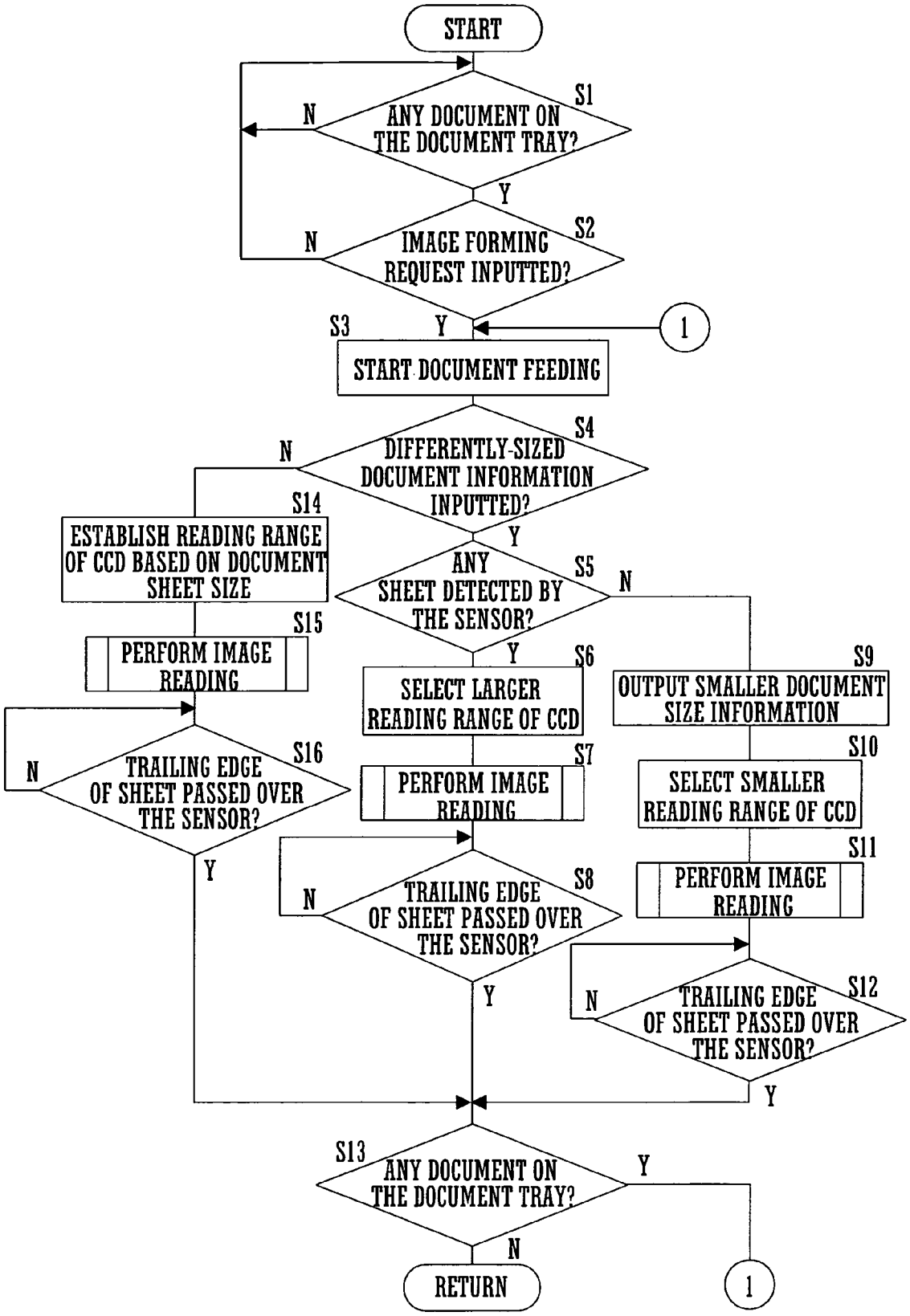
FIG. 6 is a flowchart of process steps performed by the control section 20 of the document reader 1.

FIG. 6 is a flowchart of process steps performed by the control section 20 of the above-described document reader 1. When a document is placed on the document tray 2 (step S1), the CPU 21 of the document reader 1 waits for a document read request to be inputted from the CPU 31 of the image forming apparatus 100 (step S2). When a start key on the operating panel of the image forming apparatus 100 is operated to cause the CPU 31 to input the document read request to the CPU 21, the CPU 21 causes the pickup roller 4 and the feed roller 5A to rotate thereby starting feeding of document sheets from the document tray 2 (step S3).

Then, the CPU 21 judges whether or not differently-sized document information has been inputted from the CPU 31 (step S4). If the differently-sized document information has been inputted from the CPU 31 by selection of the differently-sized document read mode at the operating panel of the image forming apparatus 100, the CPU 21 judges whether or not the document size sensor 7 has detected a document sheet at the time of passage of the leading edge of the document sheet fed from the document tray 2 through the location of the document size sensor 7 (step S5).

If it is judged that the document size sensor 7 has detected the document sheet, then the CPU 21 judges the document sheet fed from the document tray 2 as being a larger-sized document sheet and selects range L1 in FIG. 4 as the reading range of the CCD image sensor 11A (step S6). The CPU 21 starts image information reading from the document sheet at the time the leading edge of the document sheet reaches the image read position P1 (step S7). When the document size sensor 7 assumes a non-detecting state where any document sheet is undetected, the CPU 21 judges whether or not any document sheet is present on the document tray 2 (step S8→S13).

If it is judged that the document size sensor 7 has not detected any document sheet in step S5, the CPU 21 judges the document sheet fed from the document tray 2 as being a smaller-sized document sheet, selects range L2 in FIG. 4 as the reading range of the CCD image sensor 11A (step S9), and then outputs smaller document size information to the CPU 31 (step S10). Subsequently, the CPU 21 starts image information reading from the document sheet at the time the leading edge of the document sheet reaches the image read position P1 (step S11). When the document sensor 6 assumes a non-detecting state where any document sheet is undetected, the CPU 21 judges whether or not any document sheet is present on the document tray 2 (step S12→S13).

If the differently-sized document information has not been inputted in step S4, the CPU 21 establishes a reading range of the CCD image sensor 11A based on document size information (step S14) and then starts image information reading from the document sheet at the time the leading edge of the document sheet reaches the image read position P1 (step S15). Thereafter, when the document size sensor 7 assumes a non-detecting state where any document sheet is undetected, the CPU 21 judges whether or not any document sheet is present on the document tray 2 (step S16→S13).

The process returns to step S3 if any document sheet is present in step S13, and the CPU 21 performs the process steps S3 to S13 repeatedly until completion of image information reading from all the document sheets placed on the document tray 2.

The CPU 21 outputs to the CPU 31 image information read in any one of the steps S7, S11 and S15.

As can be understood from above, the CPU 21 of the document reader 2 corresponds to the judgment section defined by the present invention. If a series of differently sized document sheets including mixed document sheets of different sizes is placed on the document tray 2 with the differently-sized document read mode selected, the CPU 21 judges whether a document sheet fed from the document tray 2 is a larger-sized document sheet of A3- or B4-size or a smaller-sized document sheet of A4- or B5-size based on the detection signal from the document size sensor 7, and then establishes a proper image information reading range of the CCD image sensor 11A based on the judgment made.

Thus, if the document sheet fed from the document tray 2 is a smaller-sized document sheet, the reading range of the CCD image sensor 11A can be reduced to avoid reading of and image processing on unnecessary image information from outside the document region.

Figure 7:
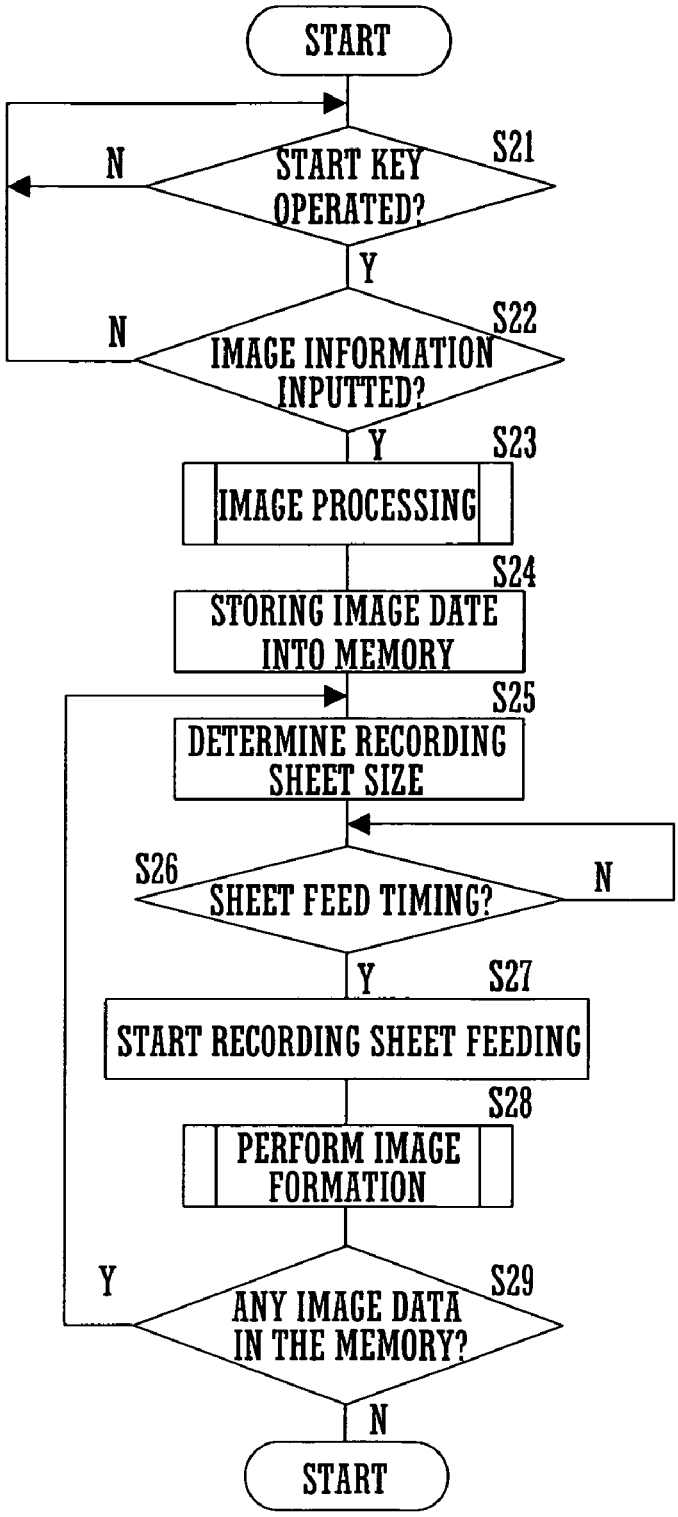
FIG. 7 is a flowchart of process steps performed by the control section 30 of the image forming apparatus 100.

FIG. 7 is a flowchart of process steps performed by the control section 30 of the image forming apparatus 100. When the start key on the operating panel is operated, the CPU 31 of the image forming apparatus 100 waits for an input of image information (steps S21 and S22). When the image information is inputted from the CPU 21, the CPU 31 performs image processing on the image information inputted and stores the processed image information as image data into memory (steps S23 and S24). Subsequently, the CPU 31 determines a size of a recording sheet to be fed (step S25), feeds the recording sheet of the size determined with predetermined timing (steps S26 and S27), and then starts image formation based on the image data stored in the memory (step S28). The CPU 31 performs the process steps S25 to S28 repeatedly until the image data in the memory runs out (step S29).

In step S25 the CPU 31 determines a recording sheet size from, for example, an image forming magnification established through the operating panel and document size information inputted from the CPU 21. If smaller document size information is inputted from the CPU 21 in the differently-sized document read mode, the CPU 31 modifies document size information from A3 or B4 size to A4 size and then determines a fresh recording sheet size from the modified document size information and the image forming magnification established. The CPU 31 feeds a recording sheet of the size determined at the time of image formation based on the image information associated with the smaller document size information. When the input of small document size information is stopped, the CPU 31 restores the initial document size information.

The above-described process enables image formation based on image information read from a smaller-sized document sheet in the differently-sized document read mode to be performed on a recording sheet of the size suited not to a larger-sized document sheet but to a smaller-sized document sheet, thereby effectively utilizing resources.

If a smaller-sized document sheet is fed from the document tray 2 in the differently-sized document read mode, image information inputted from the CPU 21 of the document reader 1 does not include unnecessary image information from outside the document region and, therefore, the image processing section 34 can be prevented from performing image processing on such unnecessary image information.

It is to be noted that the image forming apparatus 100 may have a scanner and facsimile function such as to output image information read by the image read section 110 to an external device, in addition to the copy function of forming an image on a recording sheet fed from the sheet feed section 250 at the image forming section 210 based on image information read by the image read section 110.

The foregoing embodiments are illustrative in all points and should not be construed to limit the present invention. The scope of the present invention is defined not by the foregoing embodiment but by the following claims. Further, the scope of the present invention is intended to include all modifications within the meanings and scopes of claims and equivalents.

What is claimed is:

1. A document reader, comprising:

a document tray for document sheets of different sizes to be placed thereon;

a document feed path for feeding the document sheets one by one from the document tray;

a document guide, selectively adjustable to a plurality of document guide positions in the direction perpendicular to the sheet feed direction, for guiding the document sheets of different sizes to the document feed path;

an image reading device configured to read image information from each of the document sheets under feeding at an image read position on the document feed path;

at least one sensor configured to detect the presence or absence of a document sheet at a location on the document feed path between the document tray and the image read device, and between first and second positions on which respective edges of different-sized first and second document sheets to be placed on the document tray pass, the first and second positions being situated on at least one side of the document feed path in a direction perpendicular to a sheet feed direction, wherein the at least one sensor is disposed so as to be movable to one of a plurality of sensor positions in the direction perpendicular to the sheet feed direction when the document guide is adjusted, a position of the at least one sensor being changed with a change in a position of the document guide, each of the plurality of document guide's positions corresponding to one of the plurality of sensor positions; and a judgment section configured to judge which of the first and second document sheets is under feeding based on a result of detection by the sensor, wherein the image reading device has the length of a maximum-size document sheet in a direction perpendicular to a sheet feed direction and an image information reading range which is variable based on the result of detection by the sensor.

2. The document reader according to claim 1, further comprising a secondary feed path connecting a side of the document feed path downstream of the image read position to a juncture on a side of the document feed path upstream of the image read position, wherein the sensor is disposed on the document feed path at a location upstream of the juncture.

3. An image forming apparatus, comprising:

a document reader including, a document tray for document sheets of different sizes to be placed thereon, a document feed path for feeding the document sheets one by one from the document tray, a document guide, selectively adjustable to a plurality of document guide positions in the direction perpendicular to the sheet feed direction, for guiding the document sheets of different sizes to the document feed path, an image reading device configured to read image information from each of the document sheets under feeding at an image read position on the document feed path, at least one sensor configured to detect the presence or absence of a document sheet at a location on the document feed path between the document tray and the image read device, and between first and second positions on which respective edges of different-sized first and second document sheets to be placed on the document tray pass, the first and second positions being situated on at least one side of the document feed path in a direction perpendicular to a sheet feed direction, wherein the at least one sensor is disposed so as to be movable to one of a plurality of sensor positions in the direction perpendicular to the sheet feed direction when the document guide is adjusted, a position of the at least one sensor being changed with a change in a position of the document guide, each of the plurality of document guide's positions corresponding to one of the plurality of sensor positions, and a judgment section configured to judge which of the first and second document sheets is under feeding based on a result of detection by the sensor, wherein the image reading device has the length of a maximum-size document sheet in a direction perpendicular to a sheet feed direction and an image information reading range which is variable based on the result of detection by the sensor;

an image forming section configured to form an image on a recording medium based on image information read from a document sheet by the document reader; and a control section configured to change image forming conditions under which the image is formed by the image forming section based on a result of judgment made by the judgment section.

4. The image forming apparatus according to claim 3, wherein the image forming conditions include a size of the recording medium on which the image is to be formed.

* * * * *